US007771327B1

(12) United States Patent
Reams

(10) Patent No.: US 7,771,327 B1
(45) Date of Patent: Aug. 10, 2010

(54) EXERCISE DEVICE WITH FOOTBOARDS HAVING TUBULAR SUPPORT

(76) Inventor: Terry Reams, 3306 W. Short 13th, Pine Bluff, AR (US) 71603

( * ) Notice: Subject to any disclaimer, the term of this patent is extended or adjusted under 35 U.S.C. 154(b) by 0 days.

(21) Appl. No.: 12/417,116

(22) Filed: Apr. 2, 2009

(51) Int. Cl.
*A63B 23/08* (2006.01)
*A63B 21/02* (2006.01)
*A63B 21/04* (2006.01)

(52) U.S. Cl. ..... 482/80; 482/123; 482/129

(58) Field of Classification Search ..... 482/52, 482/60, 79, 80, 122, 123, 128–130; 601/27, 601/29

See application file for complete search history.

(56) References Cited

U.S. PATENT DOCUMENTS

| | | | | |
|---|---|---|---|---|
| 3,421,760 | A * | 1/1969 | Freeman, Jr. | 482/80 |
| 3,525,522 | A * | 8/1970 | Piller | 482/80 |
| 3,672,670 | A | 6/1972 | Burzenski | |
| 3,741,540 | A * | 6/1973 | Shimizu | 482/80 |
| 5,230,676 | A | 7/1993 | Terauds | |
| 5,267,923 | A | 12/1993 | Piaget et al. | |
| 5,298,002 | A * | 3/1994 | Lin | 482/53 |
| 5,433,684 | A | 7/1995 | Carrillo | |
| 5,755,651 | A * | 5/1998 | Homyonfer et al. | 482/146 |
| 5,765,921 | A * | 6/1998 | Chuang | 297/423.46 |
| 6,572,514 | B1 * | 6/2003 | Calafato | 482/79 |
| 6,796,928 | B1 * | 9/2004 | Christopher et al. | 482/51 |
| 7,322,907 | B2 | 1/2008 | Bowser | |
| 7,361,127 | B2 | 4/2008 | Tremayne | |
| 2004/0097343 | A1 * | 5/2004 | Chen | 482/79 |
| 2005/0164844 | A1 * | 7/2005 | Johnson | 482/79 |
| 2006/0270526 | A1 * | 11/2006 | Jyr | 482/53 |
| 2007/0179022 | A1 * | 8/2007 | Chen | 482/51 |
| 2008/0146421 | A1 * | 6/2008 | Hsieh | 482/129 |

* cited by examiner

*Primary Examiner*—Loan H Thanh
*Assistant Examiner*—Allana Lewin
(74) *Attorney, Agent, or Firm*—J. Charles Dougherty

(57) ABSTRACT

An exercise device comprises a tubular support with attached pivoting footboards. The footboards are biased such that pressing the footboards forward causes an exercise effect in the user's lower body. Resilient cords may be used that are attached to the device, such that pulling the handles attached to the resilient cords causes an exercise effect in the user's lower body. The tubular construction of the support allows the device to be constructed in such a manner as to reduce its weight and footprint, and increase its portability, over other exercise devices providing comparable exercise opportunities.

8 Claims, 3 Drawing Sheets

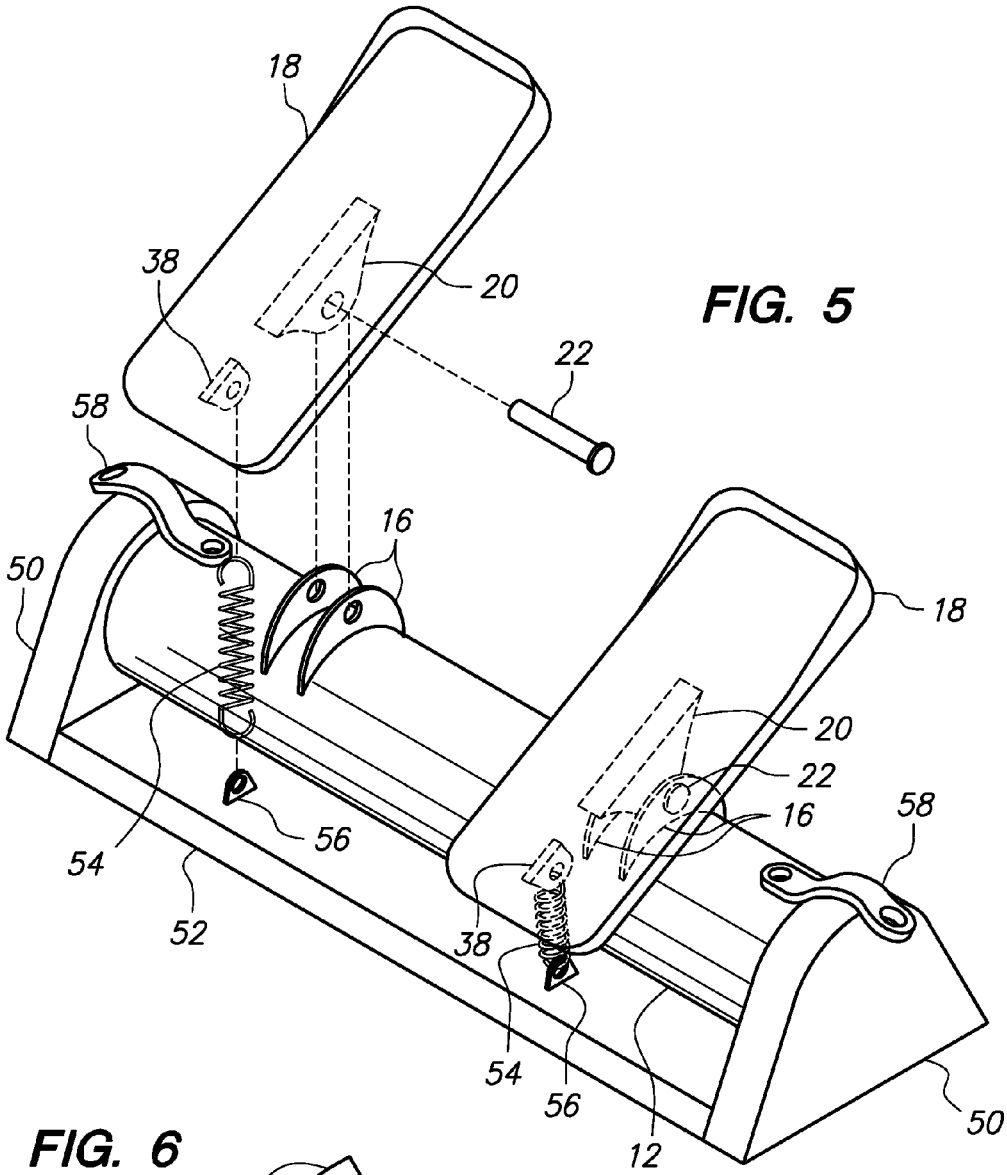
FIG. 5
FIG. 6
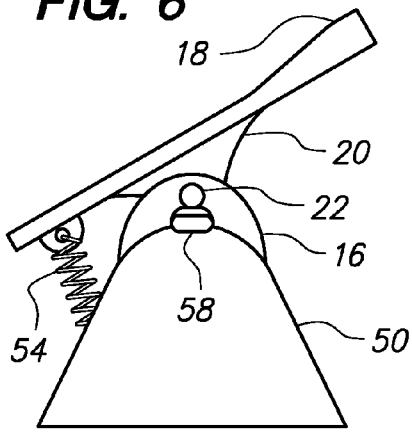
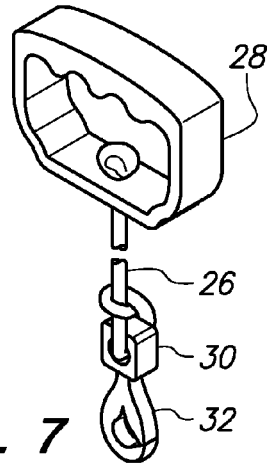
FIG. 7

EXERCISE DEVICE WITH FOOTBOARDS HAVING TUBULAR SUPPORT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to exercise devices, and in particular to exercise devices that incorporate pivoting footboards.

2. Brief Description of the Related Art

The art contains a number of examples of exercise or training devices that utilize pivoting footboards. For example, U.S. Pat. No. 3,741,540 to Shimizu teaches a "nether limbs training implement" with spring-loaded footboards. The footboards are supported by a large, flat base block. U.S. Pat. No. 5,755,651 to Homyonfer et al. teaches a leg exercise device with at least one pivoting plate member. The pivoting members are supported by a large, four-sided, rectangular base. U.S. Pat. No. 5,267,923 to Piaget et al. teaches a foot exercise device that operates by pneumatic means using foot treadles. Again, the device is supported on a large, rectangular base, which in this case houses an airway to allow air to travel between the bellows that support each foot treadle. The large size, large weight, and shape of the base of these devices limits their usefulness, since compactness and portability are known to be critical in encouraging persons to purchase and regularly use exercise equipment.

The art also contains a number of examples of exercise or training devices that utilize handles that may be pulled in order to exercise the arms of the user while the user is seated. For example, U.S. Pat. No. 7,361,127 to Tremayne teaches an exercise device that mounts to a chair, with resilient means that have handles attached at an end. U.S. Pat. No. 7,322,907 to Bowser teaches a chair that functions as an exercise device with resistance cables having handles attached. Since these devices are attached to or integrated into a chair, they are correspondingly less portable than a similar free-standing exercise device, and would be difficult for a user to frequently employ in multiple exercise locations unless multiple such devices were purchased.

In addition, the art contains a number of examples of attempts to combine devices that use footboards to exercise a user's lower body with resilient or resistance cables intended to exercise a user's upper body. For example, U.S. Pat. No. 5,230,676 to Terauds teaches a baggage carrier that may also be used as an exerciser, having two "force engaging plates" to receive the user's feet, force resistive pistons to provide resistance upon depression of the plates, and elastic bands with handles to provide upper body exercise. Like the other devices with footboards described above, this patent teaches a large, generally rectangular base plate to support the device. U.S. Pat. No. 5,267,923 to Piaget et al., which was discussed above, also teaches in one embodiment the combination of the foot treadle-driven device with lines attached to hand grips. Pulling of the handles may serve to operate the bellows portion of the device similarly to depressing the foot treadles.

The lines are cross-linked with the foot treadles to provide a desired rhythm between hand and foot movements.

Each of the devices discussed above is either integrated with or mounted to another piece of furniture—particularly a chair—or requires a relatively large amount of floorspace due to the large "footprint" of the device. This factor serves to discourage users from purchasing such a device, or to use the device as part of a regular exercise program once purchased. The large size and weight results in a lack of portability of such devices, which also discourages their use, particularly by users who must travel between various locations frequently and thus require exercise equipment that is highly portable. These limitations of the prior art are overcome by the present invention as described below.

References mentioned in this background section are not admitted to be prior art with respect to the present invention.

BRIEF SUMMARY OF THE INVENTION

The present invention is directed to an exercise apparatus that has a relatively small size, low weight, and small footprint, and is therefore highly portable. In particular, the base of the present invention is formed by means of a tube. The superior strength provided by the tubular form allows the utilization of a base that is of relatively small size and weight compared to other exercise devices, while still providing sufficient strength to support the device despite the stress caused by frequent use.

The present invention in one aspect is an exercise apparatus comprising a center tube, a plurality of footboards pivotally attached at the tube, and a resilient element attached at each of the footboards operable to bias the footboards downwardly at their rearward end. In one embodiment of this aspect of the present invention, the invention further comprises first and second side tubes parallel to and attached to the center tube. In another embodiment of this aspect of the present invention, the invention comprises a plurality of feet attached at the center tube positioned under and perpendicular to the center tube. In still another embodiment of this aspect of the present invention, the invention comprises a plurality of side walls attached at each end of the center tube positioned perpendicularly to the center tube. Resilient cords for upper body exercise may be attached in various particular embodiments of this aspect of the present invention.

It is therefore an object of the present invention to provide for an exercise apparatus to optionally simultaneously exercise a user's upper and lower body.

It is a further object of the present invention to provide for an exercise apparatus that has a low weight.

It is also an object of the present invention to provide an exercise apparatus that has a small footprint.

It is also an object of the present invention to provide an exercise apparatus that is highly portable.

These and other features, objects and advantages of the present invention will become better understood from a consideration of the following detailed description of the preferred embodiments and appended claims, in conjunction with the drawings as described following:

BRIEF DESCRIPTION OF THE SEVERAL VIEWS OF THE DRAWINGS

FIG. 5 is a perspective view, in partial cut-away, of a third preferred embodiment of the present invention.

FIG. 6 is a side elevational view of a third preferred embodiment of the present invention.

FIG. 7 is a perspective view of a handle and resilient band attachment according to each of three preferred embodiments of the present invention.

DETAILED DESCRIPTION OF THE PREFERRED EMBODIMENT(S)

Figure 1:
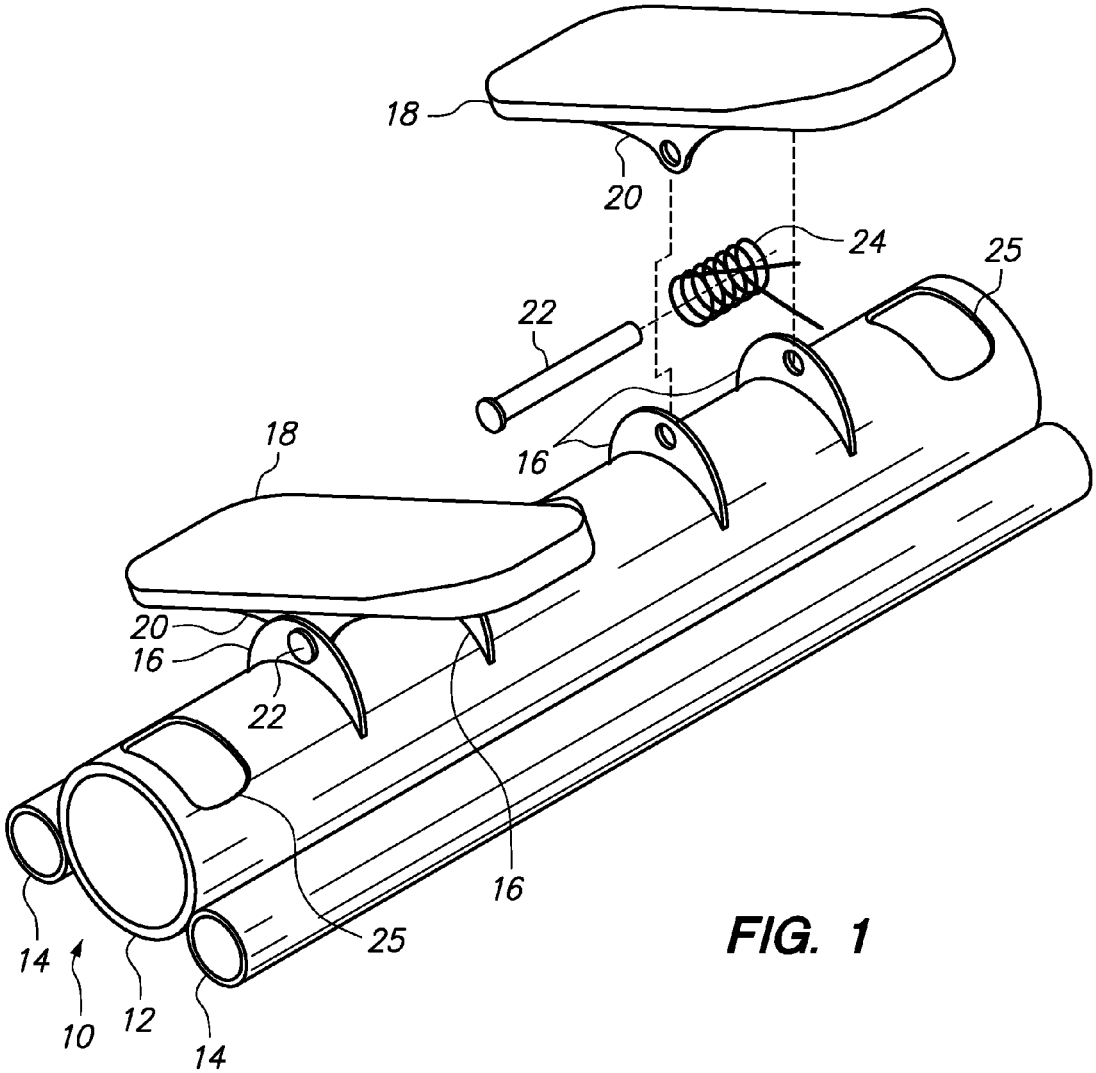
FIG. 1 is a perspective view of a first preferred embodiment of the present invention.
Figure 2:
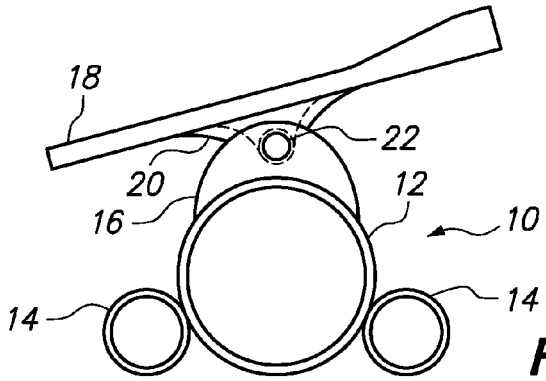
FIG. 2 is a side elevational view, in partial cut-away, of a first preferred embodiment of the present invention.

With reference to FIGS. 1-2 and 7, a first preferred embodiment of the present invention may be described. Base 10 is formed of three tubes, a center tube 12 and two side tubes 14. Tubes 12 and 14 are preferably hollow in order to lower the weight of base 10, although they may be solid in alternative embodiments. Tubes 12 and 14 may be formed of any sufficiently strong and light material, aluminum being used in the preferred embodiment. Tubes 12 and 14 may be connected by any conventional means, welding being the preferred method of joining the tubes for strength, and to avoid the additional weight that would be incurred by the use of metal fasteners such as bolts and nuts.

Four tube flanges 16 are attached perpendicularly to tube 12. Tube flanges 16 may preferably be attached as by welding. Alternatively, tube flanges 16 may be formed integrally with tube 12 in the molding process. Each of the two footboards 18 have a pair of footboard flanges 20 extending perpendicularly downwardly from footboards 18, positioned so as to align with tube flanges 16 as shown in FIG. 1. Footboards 18 may preferably have an attached non-slip surface (not shown), which may be formed of rubber or a similar material as is well known in the art. Footboards 18 may also preferably incorporate a small lip at the forward end of footboards 18 in order to further decrease the likelihood that a user's foot may slip from footboards 18 during use. A pin 22 passes through matched openings in each of the footboard flange 20 and tube flange 16 pairs, thereby holding each footboard 18 pivotally in place with respect to base 10, as shown in FIG. 1. Pin 22 may be locked in place using a cotter pin (not shown), or other conventional means as known in the art.

A spring 24 is fitted over each pin 22, between the matching pairs of footboard flanges 20 and tube flanges 16. Spring 24 is fitted such that its extending ends tend to bias the rearward end of each footboard 18 downward, with the forward end of each footboard 18 thereby being biased upward. Spring 24 is chosen such that the force that is necessary to bring the forward end of footboards 18 downward is sufficient to provide an exercise effect to the user of the device.

Two resilient cords 26, as shown in FIG. 7, are preferably attached at one end to a handle 28. It may be noted however, that cords 26 may optionally be omitted from this and other preferred embodiments of the present invention. Handle 28 is sized and shaped to be comfortably held in the user's hand, and may be preferably formed of plastic or like material with sufficient strength and light weight. In the first preferred embodiment, cord 26 is attached at center tube 12 by means of openings 25 at either end of center tube 12. To attach cord 26, it is looped through opening 25 and out the open adjacent end of center tube 12, then pulled back through cord loop 32 at one end of cord 26. The result is a knot similar to that formed by a lasso, which will tighten when pulled. Cord 26 is formed of a material, such as rubber, that may be stretched by means of the application of pulling force at handle 28.

Figure 3:
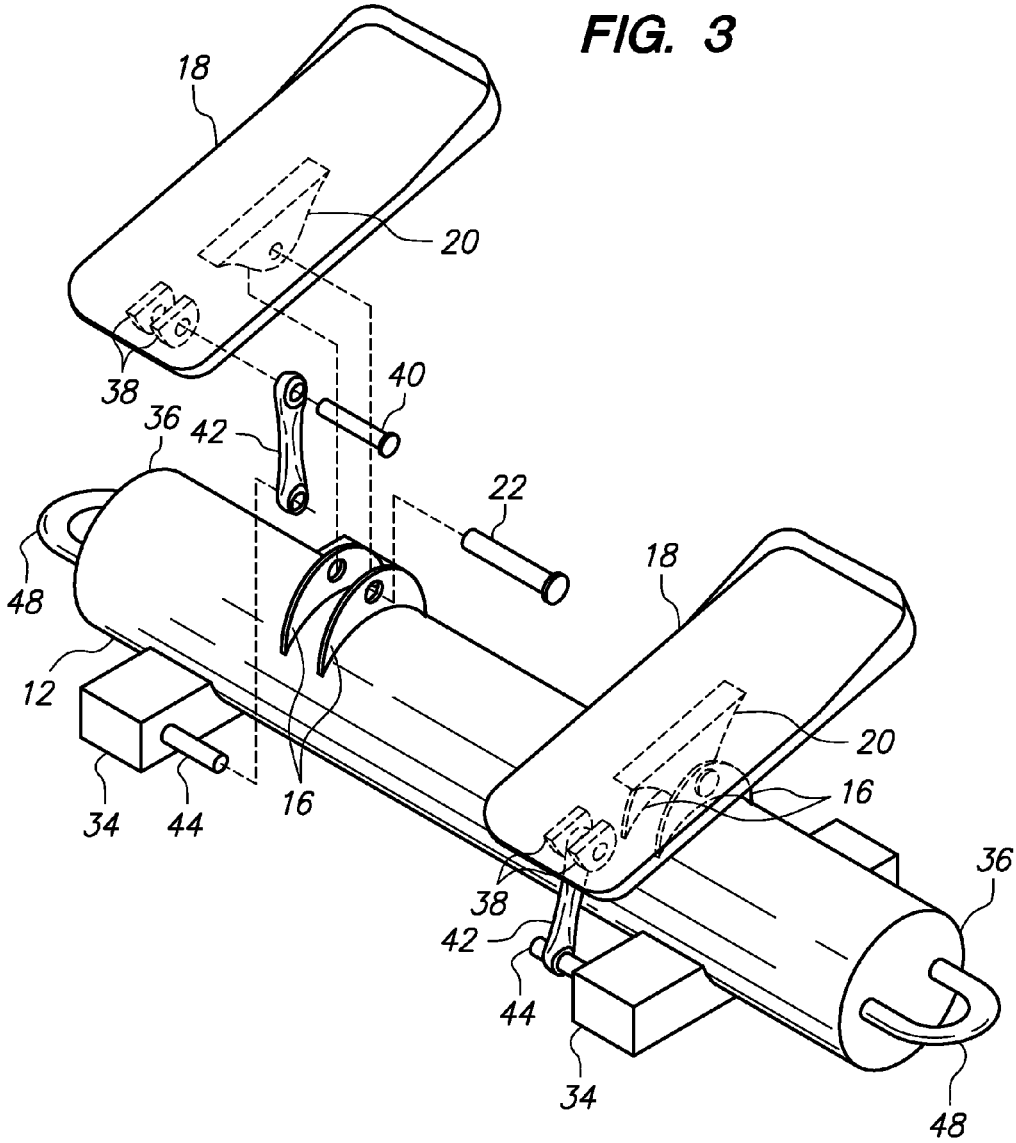
FIG. 3 is a perspective view, in partial cut-away, of a second preferred embodiment of the present invention.
Figure 4:
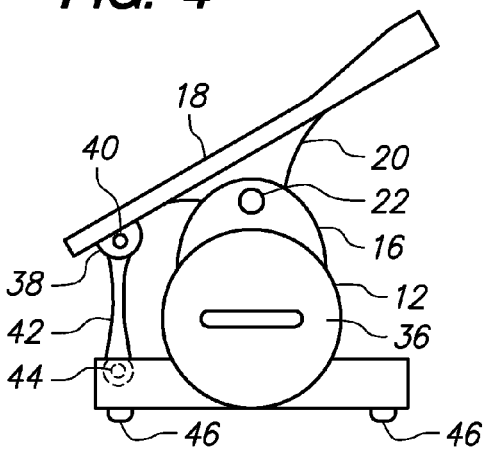
FIG. 4 is a side elevational view, in partial cut-away, of a second preferred embodiment of the present invention.

Turning now to FIGS. 3-4 and 7, a second preferred embodiment of the present invention may be described. In this case, side tubes 14 are missing and center tube 12 is supported by feet 34. Feet 34 are preferably positioned perpendicularly to and below center tube 12, as shown in FIG. 3. An arcuate notch is preferably cut in each of feet 34 to receive center tube 12, and they are attached together at this notch, preferably by welding. In alternative embodiments, the notch in feet 34 may be omitted, and feet 34 may simply be attached under center tube 12 as by welding or other means. Center tube 12 is still preferably formed of a hollow tubing material, such as aluminum, but in this second embodiment center tube caps 36 preferably close off the interior of center tube 12, thereby providing additional strength at the ends of center tube 12. Feet 34 may optionally include non-slip pads 46 on their lower side, as shown in FIG. 7, to resist movement of the device with respect to the floor while in use.

Four tube flanges 16 are attached perpendicularly to the upper side of tube 12 in the second embodiment, similar to the manner used in the first embodiment, but in this case the flanges are closer together to receive a single footboard flange 20 extending perpendicularly downward from each of footboards 18. Tube flanges 16 and footboard flanges 20 may preferably be attached to center tube 12 and footboards 18, respectively, as by welding. As with the first embodiment, footboards 18 may preferably have an attached non-slip surface (not shown), as is well known in the art. Footboards 18 may also preferably incorporate a small lip at the forward end of footboards 18 in order to further decrease the likelihood that a user's foot may slip from footboards 18 during use. A pin 22 passes through matched openings in footboard flange 20 and tube flange 16 pairs, thereby holding each footboard 18 pivotally in place with respect to center tube 12. Pin 22 may be locked in place using a cotter pin (not shown) or other conventional means, as described with respect to the first preferred embodiment.

Footboards 18 in this second preferred embodiment each feature a pair of resilient means flanges 38, sized to receive a band pin 40. Band pin 40 holds one end of elastic band 42 in place with respect to footboard 18. Each of feet 34 have a foot pin 44 extending inwardly therefrom in a direction parallel to center tube 12. The purpose of foot pins 44 is to receive the opposite end of band 42, thereby connecting elastic bands 42 at each end. The elastic bands 42 provide resistance to bias the rearward end of each footboard 18 downward, with the forward end of each footboard 18 thereby being biased upward. Elastic bands 42 may be formed of rubber or similar resilient material. Elastic bands 42 are sized such that the force that is necessary to bring the forward end of footboards 18 downward is sufficient to provide an exercise effect to the user of the device.

As described above with respect to the first preferred embodiment, two resilient cords 26, shown in FIG. 7, are attached at one end to a handle 28 in this second preferred embodiment of the present invention. In this case, however, each cord 26 is attached at center tube 12 by means of D-rings 48 attached to center tube caps 36. To attach cord 26, it may be looped through a D-ring 48, then pulled back through cord loop 32 at one end of cord 26.

With reference to FIGS. 5-7, a third preferred embodiment of the present invention may now be described. In this case, side tubes 14 and feet 34 are missing, and center tube 12 is supported by walls 50 and floor 52. Optionally, floor 52 may be skeletonized in order to reduce the weight of the device, but in the preferred embodiment, and as shown in FIG. 5, is built of solid material. Aluminum or a similarly strong and light material may be used to form walls 50 and floor 52. Walls 50 are attached at the open ends of center tube 12 by welding or other means as known in the art, and similarly floor 52 is attached between walls 50.

Four tube flanges 16 are attached perpendicularly to tube 12 in the third embodiment, similar to the manner used in the first embodiment, but in this case the flanges are closer together to receive a single footboard flange 20 extending perpendicularly downward from each of footboards 18, as with the second embodiment described above. Tube flanges 16 and footboard flanges 20 may preferably be attached as by welding. Footboards 18 may preferably have an attached non-slip surface (not shown), as is well known in the art. Footboards 18 may also preferably incorporate a small lip at the forward end of footboards 18 in order to further decrease the likelihood that a user's foot may slip from footboards 18 during use. A pin 22 passes through matched openings in footboard flange 20 and tube flange 16 pairs, thereby holding each footboard 18 pivotally in place with respect to center tube 12. As noted with respect to the other preferred embodiments, pin 22 may be locked in place using a cotter pin (not shown) or other conventional means.

Footboards 18 in the third preferred embodiment, like the second preferred embodiment, also each feature a pair of resilient means flanges 38. IN this case, however, each of the flanges 38 are sized to receive one end of a vertical spring 54. The opposite end of each vertical spring 54 attaches at one of the two wall flanges 56, as shown in FIG. 5. As a result, it may be seen that vertical springs 54 provide resistance to bias the rearward end of each footboard 18 downward, with the forward end of each footboard 18 thereby being biased upward. Vertical springs 54 are formed such that the force that is necessary to bring the forward end of footboards 18 downward is sufficient to provide an exercise effect to the user of the device.

As described above with respect to the first and second preferred embodiments, two resilient cords 26, shown in FIG. 7, are attached at one end to a handle 28. In this third preferred embodiment, each cord 26 is attached at center tube 12 by means of brackets 58 attached at either end of center tube 12. Optionally, brackets 58 may be attached at walls 50, or brackets 58 may be eliminated and cords 26 may be attached directly to walls 50 by various means. To attach each cord 26, it may be looped through a bracket 58, then pulled back through cord loop 32 at one end of cord 26. Alternatively, cord nut 30 may be tied in place below bracket 58 in order to hold cord 26 with respect to bracket 58.

The method of operation for each of the three preferred embodiments is largely the same. A user, who is preferably sitting but may also be standing, places his or her feet on footboards 18. If resilient cords 26 are being used at this time, the user grasps handles 28 with each hand. The user extends his or her toes downwardly, thereby causing the forward ends of footboards 18 to pivot downwardly, with resistance to this movement being provided by springs 24, elastic bands 42, or vertical springs 54, in the first, second, and third embodiments, respectively. In each case, this resistance creates a strengthening effect in the lower body of the user, particularly the calves of the user, but other muscles are exercised as well. Simultaneously, the user may pull upwards on handles 28, with resistance being provided by the stretching of cords 28. In this manner, a strengthening effect is provided in the upper body of the user, particular the biceps of the user, but other muscles are exercised as well. Either the upper- or lower-body strengthening effects may be used individually or in tandem, as desired by the user from time to time.

The present invention has been described with reference to certain preferred and alternative embodiments that are intended to be exemplary only and not limiting to the full scope of the present invention as set forth in the appended claims. In particular, it may be noted that while the invention is presented in three separate preferred embodiments, various features of the embodiments described may be used in various combinations to implement still further embodiments of the present invention, all within the scope of the appended claims.

What is claimed is:

1. An exercise device, comprising:

(a) a center tube and first and second side tubes parallel to and attached to said center tube;

(b) a plurality of footboards pivotally attached at said center tube, wherein each of said footboards comprises a forward end and a rearward end;

(c) a spring attached at each of said footboards operable to bias each of said footboards downwardly at said rearward end of said footboard; and (d) a footboard pin, wherein each of said springs is fitted circumferentially over a footboard pin, and each of said footboard pins pivotally attaches said center tube to one of said footboards.

2. The exercise device of claim 1, wherein said center tube comprises two ends, and wherein the exercise device further comprises a pair of resilient cords, wherein each of said resilient cords is attached near one of said ends of said center tube.

3. The exercise device of claim 2, wherein said resilient cords are each attached to said center tube at an opening adjacent to one of said ends of said center tube.

4. An exercise device, comprising:

(a) a center tube;

(b) a plurality of footboards pivotally attached at said center tube, wherein each of said footboards comprises a forward end and a rearward end;

(c) a plurality of feet attached below said center tube and perpendicularly to said center tube; and (d) an elastic band attached at each of said footboards operable to bias each of said footboards downwardly at said rearward end of said footboard wherein each of said elastic bands comprises a first and second end, and wherein said first end of each said elastic band is attached at said rearward end of one of said footboards, and wherein said second end of each said elastic band is attached at one of said feet.

5. The exercise device of claim 4, further comprising at least one pad attached to each of said feet.

6. The exercise device of claim 4, wherein each of said feet further comprises a foot pin, and each of said resilient bands is attached at said second end of said resilient band at one of said foot pins.

7. The exercise device of claim 4, wherein said center tube comprises two ends, and wherein the exercise device further comprises a pair of resilient cords, wherein each of said resilient cords is attached at one of said ends of said center tube.

8. The exercise device of claim 7, wherein said device further comprises a center tube cap attached at each of said ends of said center tube and a ring attached at each of said center tube caps, and each of said resilient cords are attached to said center tube ends at one of said rings.

* * * * *